US005915546A

United States Patent [19]

Harrelson

[11] Patent Number: 5,915,546

[45] Date of Patent: Jun. 29, 1999

[54] CARTON WITH THREE-PLY HANDLE

[75] Inventor: Glen Ray Harrelson, Gainesville, Ga.

[73] Assignee: Riverwood International Corporation, Atlanta, Ga.

[21] Appl. No.: 09/061,000

[22] Filed: Apr. 16, 1998

[51] Int. Cl.[6] ..... B65D 75/00

[52] U.S. Cl. ..... 206/200; 206/428

[58] Field of Search ..... 206/427, 428, 206/141, 162, 163, 165, 200

[56] References Cited

U.S. PATENT DOCUMENTS 5,234,102 8/1993 Schuster et al. ..... 206/428 X 5,647,483 7/1997 Harris ..... 206/427

5,669,500 9/1997 Sutherland ..... 206/427

*Primary Examiner*—Jacob K. Ackun

[57] ABSTRACT

A carton includes a bottom panel, first and second opposite side panels each connected to the bottom panel, and a top connected to the side panels. First and second opposite end panels are connected to the bottom panel and to the top panel. A three-ply handle is connected to and extends between the end panels and is detachably connected to the top. The carton is formed from a blank having first and second opposite edges and a handle strip formed along the first edge and second and third handle strips formed along the second edge. The three-ply handle is made up from the first, second, and third handle strips adhered to one another.

11 Claims, 4 Drawing Sheets

CARTON WITH THREE-PLY HANDLE

TECHNICAL FIELD

The present invention relates to an article carrier and more particularly relates to a carton having a reinforced integral strap handle.

BACKGROUND OF THE INVENTION

Cartons are often provided with a handle for convenient lifting and carrying. A satisfactory handle should be designed to be readily grasped, comfortable to the hand, and capable of lifting the carton without tearing. For cartons containing heavy loads, it has been common to reinforce the handle by making it of two-ply construction. For example, in fully enclosed sleeve-type cartons, the top panel often is formed by overlapping top panel flaps located at the ends of a blank. Each flap contains a handle opening arranged so that the top panel of the carton includes two spaced openings. This arrangement is sometimes referred to as a "suitcase handle" since the strap portion of the top panel between the handle openings is gripped in the manner of a suitcase handle. An example of such a suitcase handle can be found in the carton disclosed in U.S. Pat. No. 5,333,734.

U.S. Pat. No. 2,955,739 of Collura describes a handle carton in which a two-ply handle is attached to the end flaps of a carton and is positioned above the top panel of the carton. The two-ply handle is formed along the edge of the carton blank by folding and adhering one handle strip against another. The two-ply handle is then folded yet again in a "Z" fashion, causing the handle to be separated from the top panel of the carton, while still remaining attached to the end flaps.

Recently, larger and larger containers have been placed on the marketplace. When a large number of such larger containers are placed in a single carton, greater stress is applied to the traditional two-ply handle. To increase the strength of the handle, one could increase the board thickness of the carton blank. However, this has the disadvantage of increasing the cost greatly inasmuch as a significant portion of the cost of a finished carton is the cost of the raw material making up the blank. Furthermore, the cost of the blank is directly proportional to the thickness of the blank.

Accordingly, it can be seen that a need yet remains for a carton having an integral handle which has greater strength handle than known two-ply arrangements, while at the same time avoiding excessive costs. It is to the provision of such a carton that the present invention is primarily directed.

SUMMARY OF THE INVENTION

Briefly described, in a first preferred form the present invention comprises a carton having a bottom panel, first and second side panels opposite each other and connected to the bottom panel, and a top panel connected to the side panels. First and second end panels are positioned opposite each other and are connected to the bottom panel and to the top panel. A handle is connected to and extends between the end panels, with the handle including at least three plies.

Preferably, prior to use the handle is detachably connected to the top panel and after use the handle is detached from the top panel. Also preferably, the end panels and top panel include openings which flank the three-ply handle at the intersection of the top panel and the end panels. Most preferably, the openings in the end panels taper away from a center line of the handle to help distribute weight into the end panels without tearing the handle.

Also preferably, the carton is formed from a blank having first and second opposite edges and wherein a first handle strip is formed along the first edge and second and third handle strips are formed along the second edge, with the handle being formed from the first, second, and third handle strips adhered to one another.

Preferably the end panels each include an upright portion and a canted portion to allow the shape of the carton to more closely correspond to the contour of bottles contained therein. Also preferably, the top panel is pre-scored to allow at least a portion thereof to be detached from the end panels to provide access to the interior of the carton to allow individual articles to be removed therefrom.

In another preferred form the present invention comprises a carton blank for forming a carton with an integral handle. The blank includes a bottom panel and first and second side panels connected to and flanking the bottom panel. First and second top panels are connected to and flank the first and second side panels. Also, a plurality of end flaps are connected to the bottom panel, to the top panels, and to the side panels for forming first and second opposite end panels. First and second elongate handle strips are formed adjacent a distal edge of the first top panel. A fold line divides the first elongate handle strip from the second elongate handle strip to allow the first and second elongate handle strips to be folded one against the other and adhered to each other to form a two-ply handle sub-assembly. Moreover, at least a third elongate handle strip is formed adjacent a distal edge of the second top panel. The first, second, and third elongate handle strips are shaped and positioned to allow the third elongate handle strip to be folded against the two-ply handle sub-assembly and adhered thereto to form a three-ply handle.

Preferably, the elongate handle strips are attached to some of the end flaps. Also preferably, the top panels define openings formed therein positioned adjacent the second and the at least third elongate handle strips. Also preferably, the top panels are pre-scored to allow the top panels to be torn away from the end flaps to provide ready access to the interior of the assembled carton. Also preferably, the side edges of the side panels are not entirely upright, but include an upright portion and a canted portion and some of the end flaps are adapted to conform to this shape so that the resulting carton can be tapered on the ends to better conform to the shape of bottles contained in the carton.

This construction is quite advantageous. Firstly, the handle is greatly strengthened by the use of three handle plies. In the past, the handle typically has been made of a two-ply construction, while the present invention provides a three-ply handle construction. This greatly increases the strength of the handle, thereby overcoming a significant drawback to known cartons. Moreover, by making the handle a three-ply construction, rather than simply adding additional thickness throughout the entire construction of the carton, a strong, yet economical carton is provided. This additional strength is particularly helpful should the carton become slightly wet.

Accordingly, it is an object of the present invention to provide a carton having a handle with increased strength.

It is another object of the present invention to provide a carton having a handle with improved strength while avoiding excessive additional manufacturing costs.

It is another object of the present invention to provide a carton blank which can be easily and inexpensively manufactured.

It is another object of the present invention to provide a carton blank which can be easily filled and folded around containers utilizing available equipment.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
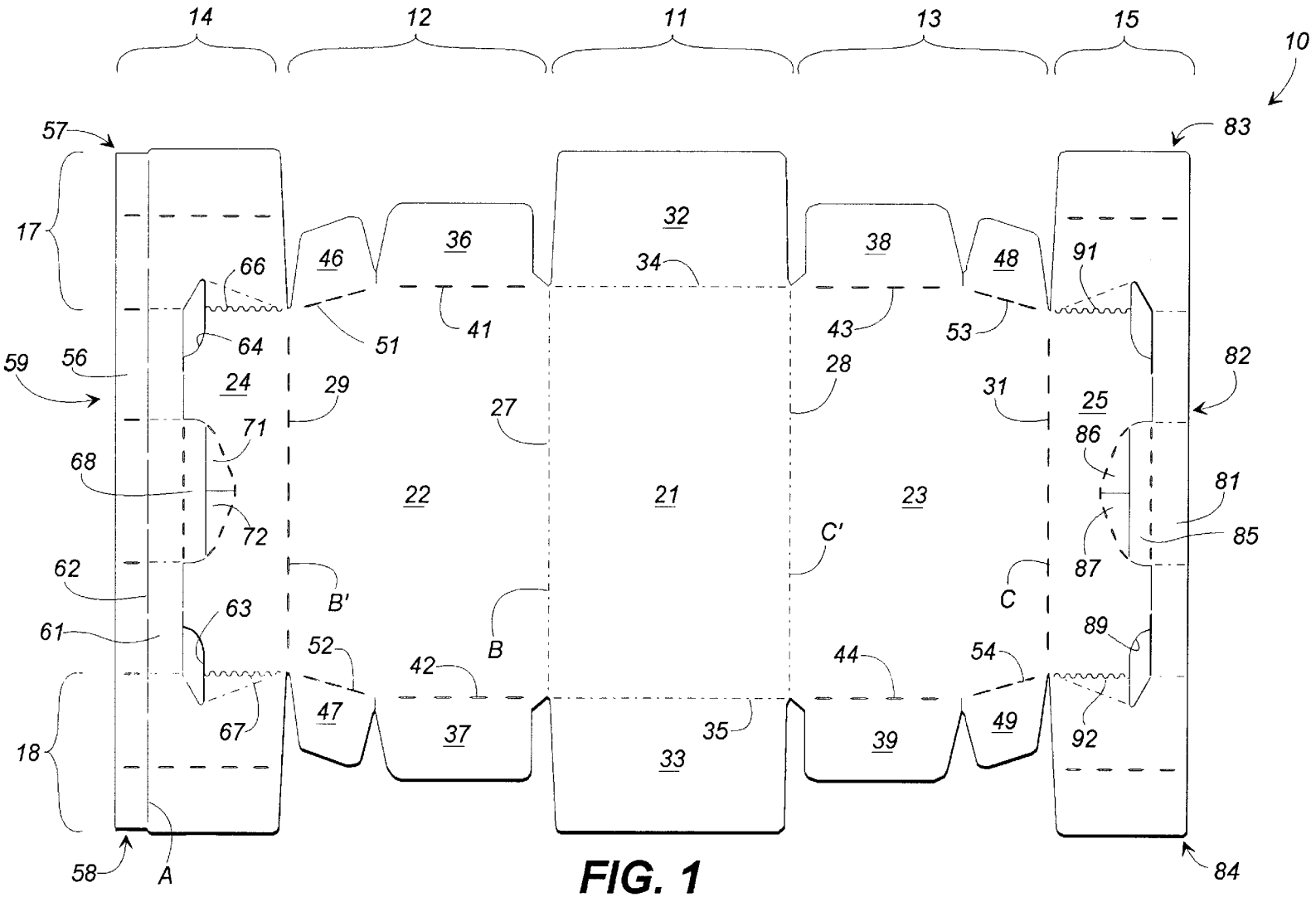
FIG. 1 is a plan view of a carton blank for making a carton according to a preferred form of the invention.

Referring now in detail to the drawing figures, wherein like reference numerals represent like parts throughout the several views, FIG. 1 shows a carton blank 10 according to a preferred form of the invention. The carton blank 10 is provided for forming a carton having a three-ply handle, as will be described subsequently. The carton blank 10 is made of coated paperboard, the thickness (gauge) of which can be varied according to the number and size of the bottles or cans to be contained therein. However, generally speaking, the thickness of the carton blank typically is in the 0.022–0.026" range.

The carton blank 10 includes a bottom section 11 and side sections 12 and 13 flanking the bottom section. Top sections 14 and 15 flank the side sections 12 and 13 respectively. The carton blank 10 also includes end flap sections 17 and 18.

The carton blank 10 includes a bottom panel 21 and side panels 22 and 23 connected to and flanking the bottom panel 21. Top flaps 24 and 25 are connected to and flank the side panels 22 and 23 respectively. Side panel 22 is foldably connected to bottom panel 21 along score line 27, while side panel 23 is foldably connected to the other side of the bottom panel 21 along score line 28. Top flap 24 is foldably and detachably connected to side panel 22 along perforated score line 29, while top flap 25 is foldably and detachably connected to side panel 23 along perforated score line 31.

Bottom end flaps 32 and 33 are foldably connected to opposite ends of the bottom panel 21 along score lines 34 and 35. Attached to the side panels 22 and 23 are lower major end flaps 36–39 which are foldably connected to the side panels 22 and 23 along perforated score lines 41–45 which are coextensive with score lines 34 and 35 and are parallel to the longitudinal direction of the carton blank 10. The side panels 22 and 23 also include upper minor end flaps 46–49 which are foldably connected to side panels 22, 23 along canted or oblique fold lines 51–54. This gives the side panels 22 and 23 a not quite rectangular shape, with an upper portion (the outboard portions in FIG. 1) of the side panels 22 and 23 tapering somewhat to more closely conform to the shape of bottles contained in the carton. Of course, if the carton is to be used to contain cans, rather than bottles, this tapered portion of the side panels can be dispensed with.

The top section 14 includes a first elongate handle strip 56 which extends from side edge 57 to opposite side edge 58 along a longitudinally distal edge 59. Positioned adjacent the first elongate handle strip 56 is a second elongate handle strip 61, divided from the first elongate handle strip 56 by heavily perforated score line 62 (such that the two elongate handle strips are connected only by small nicks). Wing-shaped openings 63 and 64 are positioned alongside the second elongate handle strip 61, with part of the openings being formed in the top flap 24, while other parts of the openings are formed in the end flap sections 17 and 18. The end flap sections 17 and 18 are foldably connected to the top flap 24 along heavily scored perforation lines 66 and 67.

A small handle flap 68 is foldably attached to the second elongate handle strip 61. Also, handle access opening flaps 71 and 72 are foldably attached to top flap 24.

Top section 15 is substantially identical to top section 14, with the notable exception being that top section 15 does not have two elongate handle strips. Accordingly, it can be seen that the top section 15 includes a third elongate handle strip 81 formed along a longitudinally distal edge 82 and extending from side edge 83 to opposite side edge 84. A small handle flap 85 is foldably connected to the third elongate handle strip 81. Handle access flaps 86 and 87 are foldably attached to the top flap 25. Wing-shaped openings 88 and 89 are positioned adjacent the third elongate handle strip 81 at the junctures of the top flap 25 with the end flap sections 17 and 18. The end flap sections 17 and 18 are foldably attached to the top flap 25 along heavily perforated score lines 91 and 92.

Figure 2:
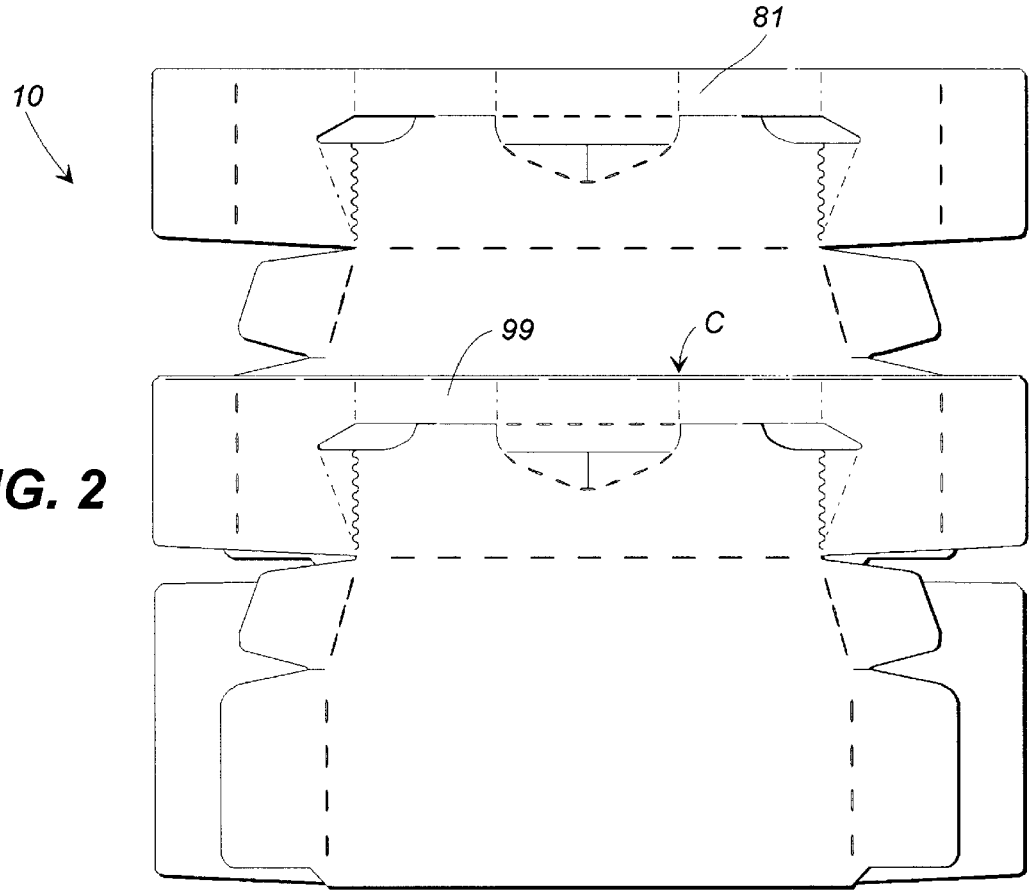
FIG. 2 is a plan view of the carton blank of FIG. 1, shown after an initial folding step.
Figure 3:
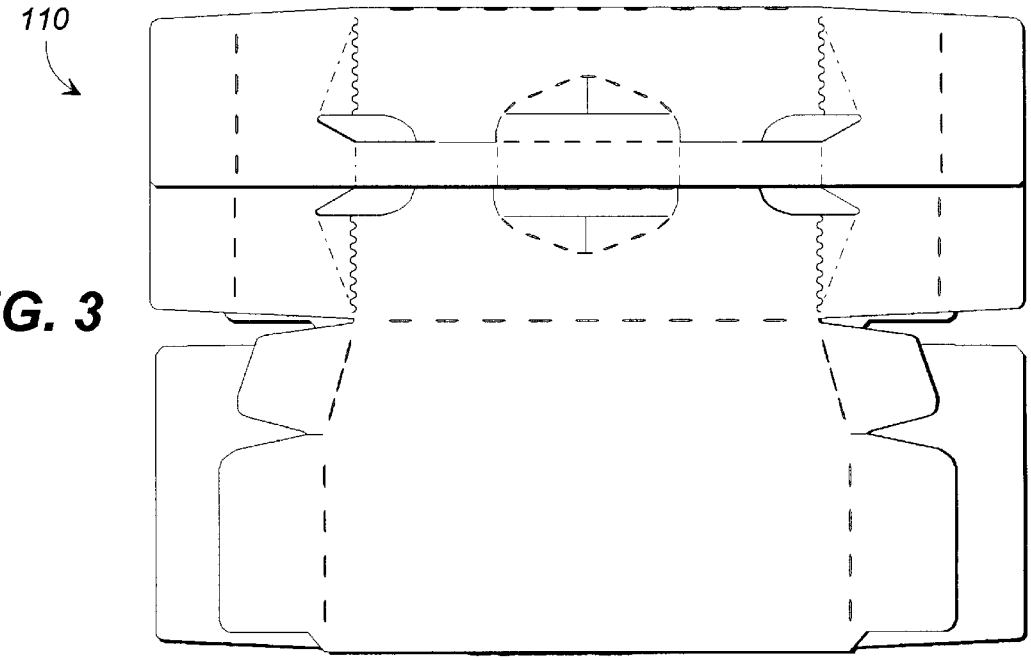
FIG. 3 is a plan view of the carton blank of FIG. 2, shown after an additional folding step.
Figure 4:
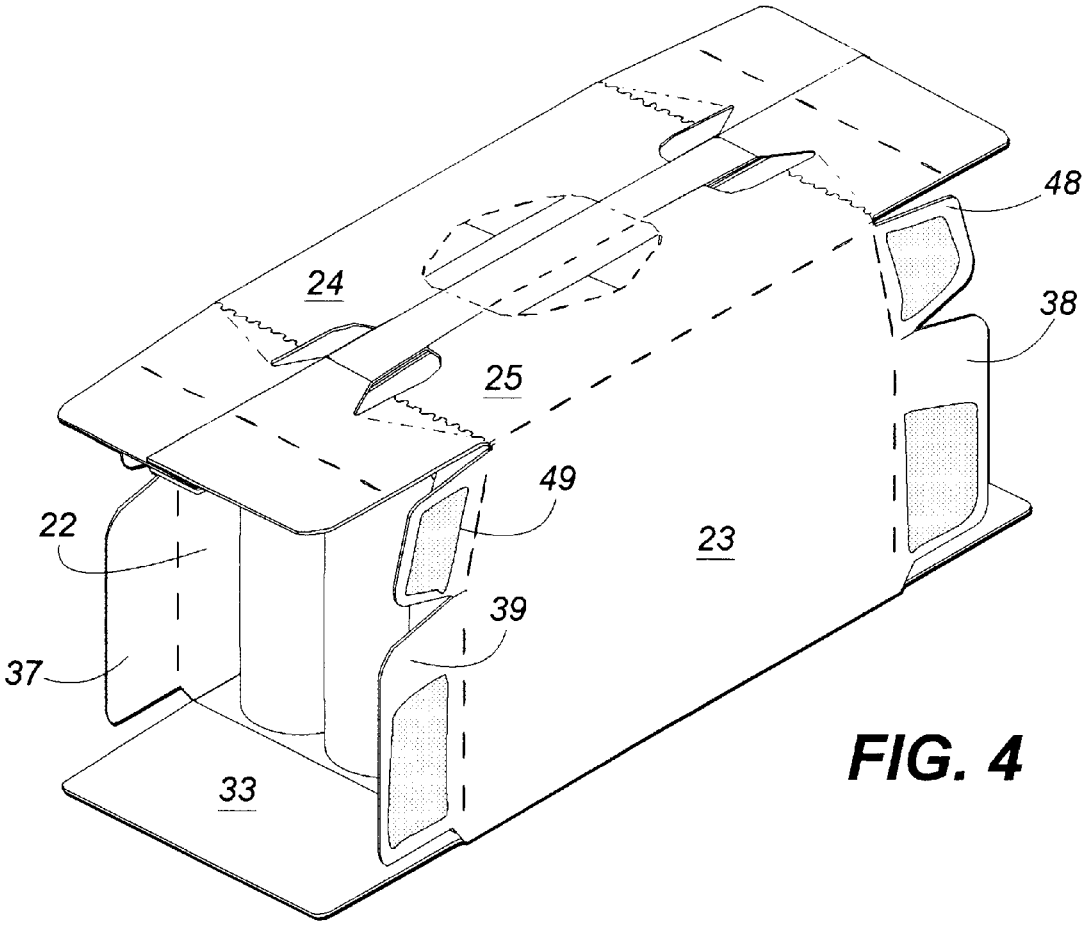
FIG. 4 is a perspective illustration of the carton blank of FIG. 3, shown erected and filled.
Figure 5:
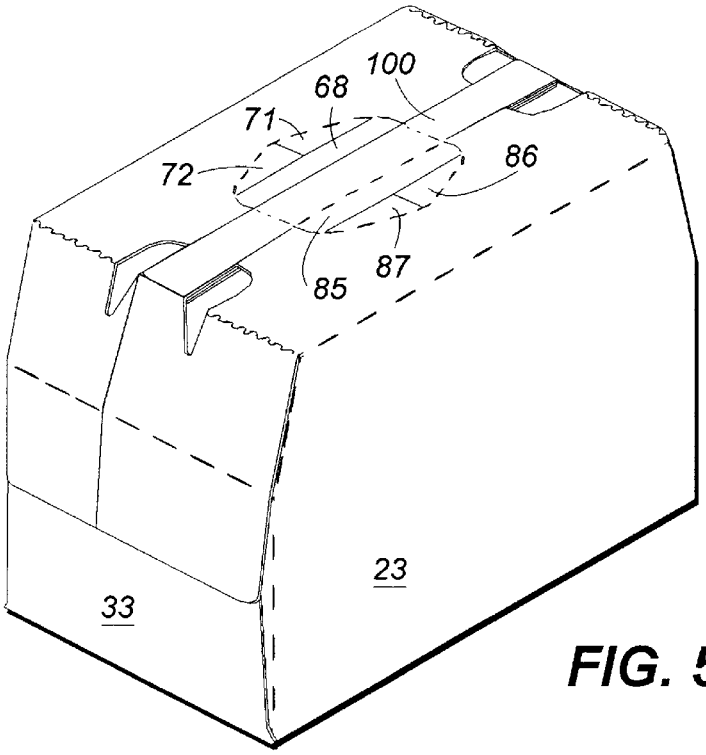
FIG. 5 is a perspective illustration of a filled and folded carton obtained from the carton blank of FIG. 4 after additional folding and sealing.

To achieve the folded configuration of FIG. 2, first the first elongate handle strip 56 of the blank 10 of FIG. 1 is folded about fold line A (corresponding to score line 62) against second elongate handle strip 61 to create a two-ply handle sub-assembly 99 (there having been an adhesive applied to one or the other of the first and second elongate handle strips). Then sections 12 and 14 are folded about fold line B, resulting in the partly-folded configuration of FIG. 2. To achieve the folded and glued and ready-to-be-utilized carton blank of FIG. 3, the carton blank of FIG. 2 is folded along fold line C (corresponding to score line 31), with adhesive having been applied either to the two-ply handle sub-assembly or to the third elongate handle strip 81. This results in a folded, ready-to-be-erected carton blank 10 having a three-ply handle 100. The blank can then be erected and bottles (or cans or other containers) inserted therein as depicted in FIG. 4. With glue applied to the major and minor end flaps, the major and minor end flaps are then folded inwardly toward each other and the bottom end flap is folded upwardly against the major end flaps to secure the bottom end flap to the major end flaps. Adhesive is applied to the outside of the bottom end flaps and the top end flap is folded downwardly against the minor end flaps and the bottom end flap to achieve the configuration of FIG. 5. The carton then is completely sealed up and ready to be shipped out containing bottles or cans or other material.

Figure 6:
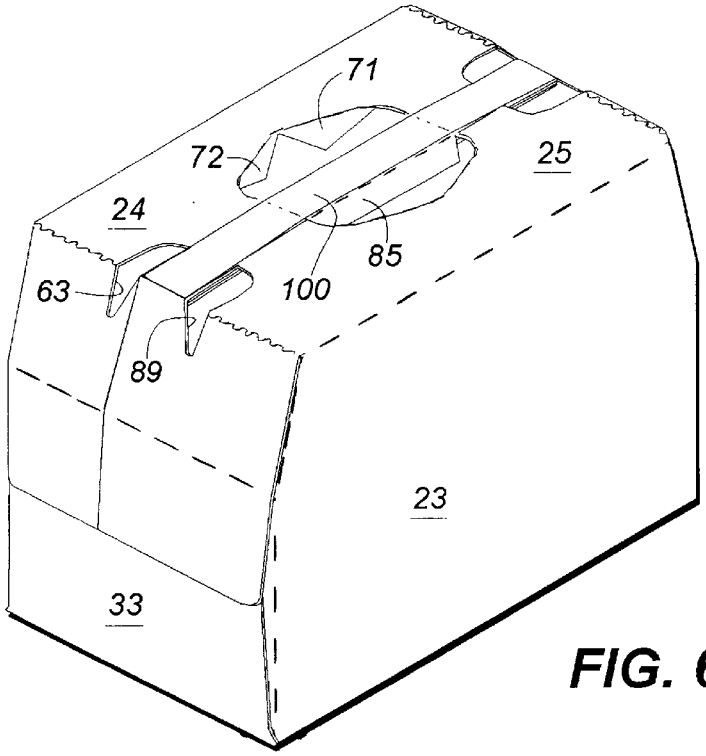
FIG. 6 is a perspective illustration of the filled carton of FIG. 5, shown with its handle detached from the remainder of the top panel thereof, such as occurs after the handle has been grasped and lifted to lift the carton.

In use by a purchaser, the filled carton can be grasped by pushing through the handle access flaps and pushing down the small handle flaps to provide ready access to grab the three-ply handle 100. Once the three-ply handle 100 has been lifted, it detaches from the top flaps 24 and 25 (see FIG. 6). In this regard, it should be noted that the weight borne by the three-ply handle is transferred to the end flaps and thence on to the bottom panel. It should be noted that the openings alongside the three-ply handle adjacent the edge of the top panel and the side panels helps to transfer the weight directly to the side panels without damaging the connection between the top panel and the side panels as would otherwise occur. Also, by tapering the openings away from the handle in the end panels, the load on the three-ply handle is more evenly distributed through the end panels and this reduces the likelihood of tearing the three-ply handle away from the end panels.

While a three-ply handle construction is shown and described above, it will be apparent to those skilled in the art that a four-ply handle construction can be made according to the invention. For example, the top section 15 can be made to be a mirror image of top section 14 such that a third and fourth elongate handle strip are provided along the distal edge 82 of the carton blank 10. Thus, a two-ply handle sub-assembly can be made on each end of the carton blank 10 and then placed one against the other and adhered thereto to make a four-ply handle. Also, while the sequence of folding is described as folding along fold lines A, then B, then C, the order could be folding along fold line A, and then folding along fold line B', and then folding along fold line C' (see FIG. 1).

While the invention has been described in preferred forms, it will be apparent to those skilled in the art that many modifications, additions, and deletions can be made therein without departing from the spirit and scope of the invention as set forth in the following claims.

I claim:

1. An carton comprising:

a bottom panel;

first and second opposite side panels each connected to said bottom panel;

a top connected to said side panels;

first and second opposite end panels connected to said bottom panel and to said top; and a handle connected to and extending between said end panels, said handle comprising at least three plies.

2. A carton as claimed in claim 1 wherein said handle, prior to use, is detachably connected to said top.

3. A carton as claimed in claim 1 wherein said end panels are connected to said top at first and second fold lines and wherein openings are formed in said top and in said end panels adjacent said fold lines on opposite sides of said handle.

4. A carton as claimed in claim 3 wherein a portion of said openings in said end panels tapers away from said handle.

5. A carton as claimed in claim 1 wherein said carton is formed from a blank having first and second opposite edges, and wherein a first handle strip is formed along said first edge and second and third handle strips are formed along said second edge, and wherein said three-ply handle comprises said first, second, and third handle strips adhered to one another.

6. A carton as claimed in claim 1 wherein said first and second end panels each comprises:

a bottom flap connected to said bottom panel;

a top flap connect to said top;

at least two side flaps connected to said side panels; and wherein said bottom flap, said top flap, and said at least two side flaps are adhered to one another.

7. A carton as claimed in claim 6 wherein each of said end panels each includes an upright portion and a canted portion to enable said carton to more closely contain bottles.

8. A carton as claimed in claim 2 wherein said top is pre-scored to allow at least a portion thereof to be detached from said end panels to provide access to the interior of said carton to allow individual articles to be removed therefrom.

9. A blank for forming a carton with an integral handle, said blank comprising:

a bottom panel;

first and second side panels connected to and flanking said bottom panel;

first and second top panels connected to and flanking said first and second side panels;

a plurality of end flaps connected to said bottom panel, said top panels, and said side panels for forming first and second opposite end panels;

wherein first and second elongate handle strips are formed adjacent a distal edge of said first top panel, and wherein a fold line divides said first elongate handle strip from said second elongate handle strip to allow said first and second elongate handle strips to be folded one against the other and adhered to one another to form a two-ply handle sub-assembly;

wherein at least a third elongate handle strip is formed adjacent a distal edge of said second top panel, and wherein said first, second, and at least third elongate handle strips are shaped and positioned to allow said third elongate handle strip to be folded against said two-ply handle sub-assembly and adhered thereto to form a three-ply handle; and wherein relief openings are formed adjacent at least two of said elongate handle strips.

10. A blank as claimed in claim 9 wherein a portion of each said relief opening tapers away from an adjacent elongate handle strip.

11. A blank as claimed in claim 9 wherein said second and third elongate handle strips are detachably connected to said top panels.

* * * * *